US010508561B2

(12) United States Patent
Pitt

(10) Patent No.: US 10,508,561 B2
(45) Date of Patent: Dec. 17, 2019

(54) SHROUD ASSEMBLY FOR A GAS TURBINE ENGINE

(71) Applicant: ROLLS-ROYCE plc, London (GB)

(72) Inventor: Simon Pitt, Derby (GB)

(73) Assignee: ROLLS-ROYCE plc, London (GB)

( * ) Notice: Subject to any disclaimer, the term of this patent is extended or adjusted under 35 U.S.C. 154(b) by 581 days.

(21) Appl. No.: 15/268,306

(22) Filed: Sep. 16, 2016

(65) Prior Publication Data

US 2017/0107842 A1 Apr. 20, 2017

(30) Foreign Application Priority Data

Oct. 14, 2015 (GB) ..... 1518131.6

(51) Int. Cl.

| | |
|---|---|
| ***F01D 11/12*** | (2006.01) |
| ***F01D 9/04*** | (2006.01) |
| ***F01D 17/02*** | (2006.01) |
| ***F01D 25/24*** | (2006.01) |

(Continued)

(52) U.S. Cl.

CPC ..... *F01D 11/122* (2013.01); *F01D 9/04* (2013.01); *F01D 17/02* (2013.01); *F01D 21/003* (2013.01); *F01D 25/12* (2013.01); *F01D 25/24* (2013.01); *F01D 25/246* (2013.01); *F05D 2220/32* (2013.01); *F05D 2240/11* (2013.01); *F05D 2260/31* (2013.01)

(58) Field of Classification Search

None

See application file for complete search history.

(56) References Cited

U.S. PATENT DOCUMENTS

| | | | | |
|---|---|---|---|---|
| 3,000,552 A * | 9/1961 | Cooper, Jr. | ..... | F01D 9/042 415/174.4 |
| 5,129,447 A | 7/1992 | Hamner | | |
| 10,077,681 B2 * | 9/2018 | Preston | ..... | F01D 25/28 |

(Continued)

FOREIGN PATENT DOCUMENTS

WO 2014/126641 A1 8/2014

OTHER PUBLICATIONS

Feb. 23, 2017 Extended Search Report issued in European Patent Application No. 16189109.8.

(Continued)

*Primary Examiner* — Igor Kershteyn
*Assistant Examiner* — Juan G Flores
(74) *Attorney, Agent, or Firm* — Oliff PLC

(57) ABSTRACT

An assembly for mounting a circumferential shroud to a casing, including a plurality of arcuate shroud segments collectively forming the circumferential shroud. Each segment includes a circumferentially extending wall and a channel extending from the wall. The channel is receivable in a hole passing through a circumferential casing and has a first connector. A fastener has a head and a shank, which is receivable in the channel and has a second connector that engages with the first connector. A first spacer receives the channel and a second spacer receives the shank and sit adjacent the head of the fastener on either side of the casing. The spacers can be selected to adjust for optimal radial positioning of the shroud and of probes received within a space defined between the casing and the shroud for monitoring rotor speed and the tip air gap of a turbine rotor contained in the casing.

13 Claims, 3 Drawing Sheets

(51) Int. Cl.
*F01D 21/00* (2006.01)
*F01D 25/12* (2006.01)

(56) References Cited

U.S. PATENT DOCUMENTS

| | | | | |
|---|---|---|---|---|
| 2004/0219009 | A1 | 11/2004 | Marchi et al. | |
| 2009/0053050 | A1 | 2/2009 | Bruce et al. | |
| 2010/0177299 | A1* | 7/2010 | Kominsky | F01D 11/20 356/5.01 |
| 2013/0209240 | A1* | 8/2013 | McCaffrey | F01D 11/22 415/173.2 |
| 2014/0230246 | A1 | 8/2014 | McMahon et al. | |

OTHER PUBLICATIONS

Mar. 29, 2016 Search Report issued in British Patent Application No. 1518131.6.

* cited by examiner

SHROUD ASSEMBLY FOR A GAS TURBINE ENGINE

TECHNICAL FIELD

The present invention relates to a shroud assembly for use in surrounding a bladed rotor, for example, in a gas turbine engine. In particular the invention concerns the shroud liner segments of a turbine stage of a gas turbine engine and an arrangement for mounting the segments within the turbine stage.

BACKGROUND TO INVENTION

In gas turbines it is desirable to reduce gas leakage around the turbine blades in order to improve the efficiency of the turbine. This can be achieved by surrounding each array of turbine blades with a ring of abradable material. As the turbine rotates the tips of the turbine blades cut a path through the abradable material, so ensuring that only a very small gap is left between the turbine blade tips and the surface of the abradable material. Since this gap is very small, leakage is restricted.

Unfortunately, in the extreme environment found within the turbine, the abradable material tends to erode over time. As a result, it is desirable to replace the abradable material at intervals. In order to simplify replacement, the abradable material is supported by shroud liners. These shroud liners are in turn attached to the structural casing of the turbine. Furthermore the shroud liners are circumferentially segmented to make assembly simpler, allow individual areas of the lining to be replaced, and to accommodate better any distortions caused by the extreme temperatures within the turbine.

It is necessary to mount the shroud segments to the structural casing so that they are held accurately relative to the blade tips. This is important since any movement is likely to increase the clearance at the blade tips, so increasing leakage. The mounting is either directly from the casing, from the stationary nozzle guide vane assemblies which precede and follow the turbine rotor and are themselves fixed to the casing, or from a combination of both.

U.S. Pat. No. 6,062,813 describes a known arrangement for mounting the shroud segments to the casing. In the disclosed arrangement, a shroud liner is made up of an annular array of circumferentially abutting shroud liner segments each of which has a first positive radial location means and a second location means to locate each segment within the casing. The location means are in the form of hooks. The first hook is arranged to enable axial insertion of the shroud segment between a bladed rotor and the casing, and the second is arranged to retain the segment in position allowing a limited amount of radial translation of the shroud segment during axial insertion of the segment. When the shroud segment is located in its desired position, the second hook provides a positive radial location to prevent radial translation of the shroud segment.

Whilst well suited to the end purpose, it has been found difficult to monitor the clearance between the shroud and the tip of the rotor blade. Consequently, there can be uncertainty as to the clearance achieved after assembly.

STATEMENT OF THE INVENTION

The present invention provides an assembly for mounting a circumferential shroud to a casing, the assembly comprising; a plurality of arcuate shroud segments collectively forming the circumferential shroud, each segment comprising a circumferentially extending wall and a channel extending radially outwardly from the wall, the channel configured to be received in a hole passing through a circumferential casing and having, at an end distal to the wall, a first connector; a fastener having a head and a shank, the shank configured to be received in the channel and having an second connector configured to engage with the first connector of the channel; a first spacer configured to receive the channel and a second spacer configured to receive the shank and sit adjacent to the head of the fastener, the spacers to be arranged, in use, either side of the casing, and a retainer for holding the first spacer against a radially inwardly facing surface of the casing.

For example (but not essentially), the casing may be a co-axially aligned circumferential casing. The casing may be the engine casing of a gas turbine engine.

The first connector may be an internal connector and the second connector an external connector. Alternatively, the first connector may be an external connector and the second connector and internal connector.

In use, the first spacer is arranged on a radially inner surface of the casing around the hole. The channel can be inserted through the first spacer and into the hole. Next, the second spacer is arranged on the shank and the fastener is inserted into the channel and the internal and external connectors are engaged to secure the assembly in position.

For example, the internal and external connectors comprise complementing screw threads. The connectors (e.g. screw threads) may be arranged to allow adjustment from inside or outside the casing. For example, a thread can be provided internally on the segment, this arrangement permits convenient lowering/removal of the segment. Either or both of the spacers may comprise a washer. Washers may optionally include a curved profile which matches the radii of the casing/segment. The geometry and dimensions of the first spacer can be selectively chosen to set the segment and an optionally abradable radially inner surface thereof in an optimal position with respect to the tips of rotor blades of a turbine encased by the casing. The geometry and dimensions of the second spacer can be selectively chosen to set the position of the shank with respect to the segment circumferentially extending wall.

For example, the fastener can be a simple bolt. The fastener may optionally be integrally formed with the casing, for example by designing into the casing manufacture, or by physically or chemically bonding the fastener to the casing prior to assembly with other components.

For example in embodiments where the casing is for a gas turbine engine, the fastener optionally incorporates a probe which is configured and arranged to monitor rotational speed and air tip gap through the turbine. The second spacer can be selectively chosen to set the position of the probe to an optimum position for monitoring the parameter. It will be understood that in the case of a gas turbine engine, position accuracy of the probe relative to the abradable surface in the air gap is important to maintain accurate readings between engines. The fastener may comprise an axial channel into which a probe can optionally be received.

By careful selection/replacement of the spacers, the radial position of the shroud with respect to the blade tips can be carefully set and maintained in an optimal position. Appropriate adjustments to spacer size and geometry can be determined using build measurement data. In some embodiments, the height of the spacer may be adjustable by means of a screw threaded extension which engages with a complementing thread in the casing.

The assembly may further comprise additional structural components extending around the channel, radially outwardly of the circumferentially extending wall. For example, the additional structural components may comprise a double skinned wall defining a circumferentially extending cooling channel between a radially outer surface of the circumferentially extending segment wall and a radially inner wall of the casing.

The skins of the double skinned wall can conveniently be separated by a second channel extending around the shroud segment channel. This second channel may optionally incorporate one or more cooling holes. The shroud segment channel may optionally be provided with one or more cooling holes co-axially aligned with cooling holes in the second channel, for example to assist in cooling of a probe received in the shroud segment channel. A step may be provided on an outer wall of the shroud segment channel to separate the double skinned wall from the circumferentially extending wall of the segment. The double skinned wall may incorporate a platform for supporting the first spacer and/or retaining its position with respect to the casing. One or more seals may be provided between the double skinned wall and the casing. For example, these may be rope seals. The additional structural components may be secured to the casing independently of the segment. Alternatively, the additional structural components may be secured to the segment independently of the casing.

BRIEF DESCRIPTION OF DRAWINGS

An embodiment of the invention will now be described in more detail, by way of an example, with reference to the accompanying figures in which.

DETAILED DESCRIPTION OF DRAWINGS AND EMBODIMENT

Figure 1:
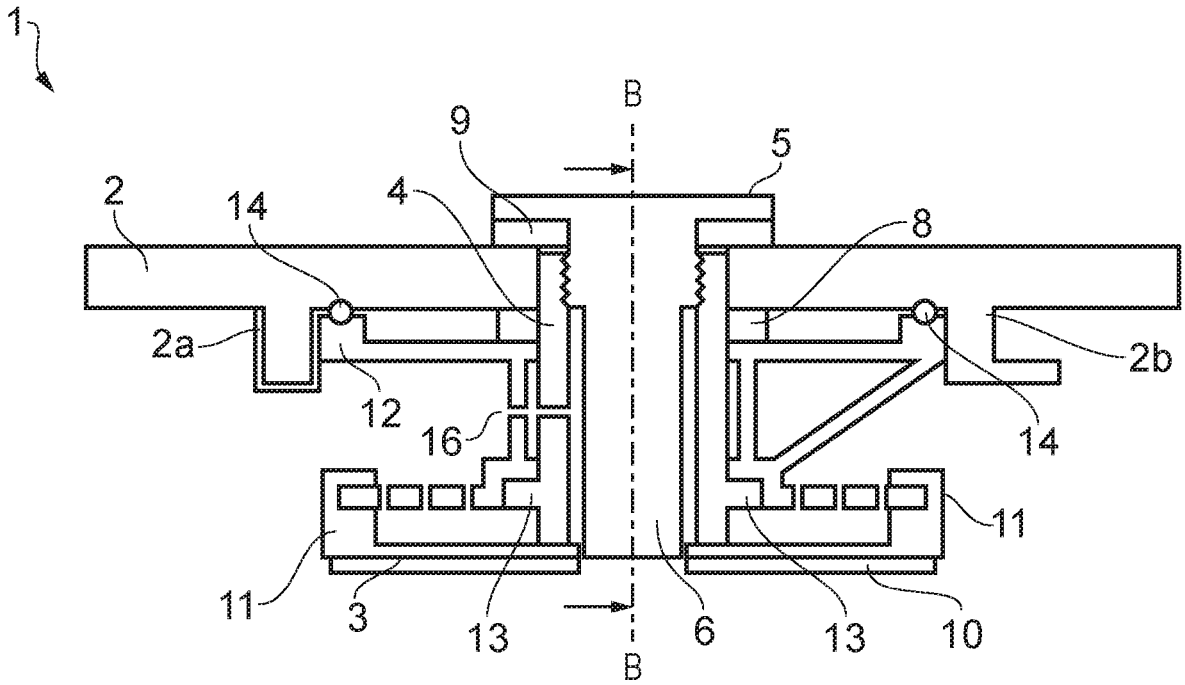
FIG. 1 shows an embodiment of an assembly in accordance with the invention in an axial section through a casing and shroud assembly.
Figure 2:
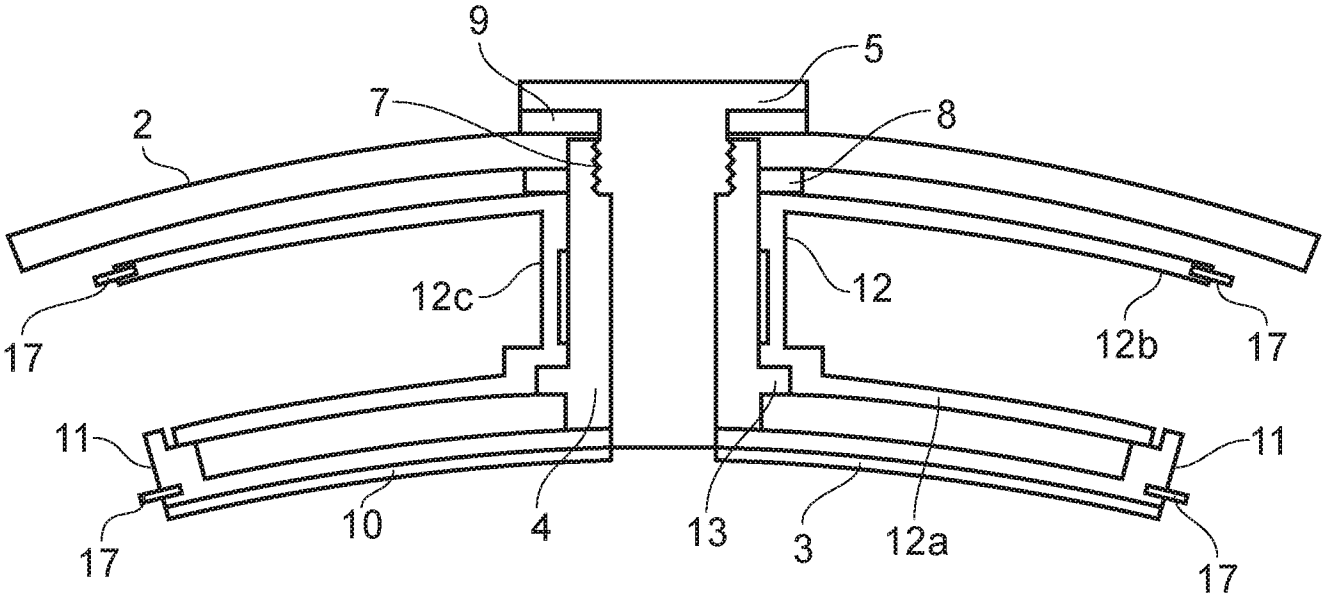
FIG. 2 shows an alternative view of the embodiment of FIG. 1 in section through the line B-B as shown in FIG. 1.

As can be seen in the Figures, an assembly 1 is secured to a casing 2 which, for example, is the casing of a gas turbine engine. The assembly 1 comprises a shroud segment having a circumferentially extending wall 3 and a channel 4 extending radially outwardly therefrom. The channel 4 is received in a hole which passes through the casing 2, from a radially inner surface of the casing 2. A fastener comprises a head 5 and a shank 6 and is received from a radially outer surface of the casing 2 through the hole of the casing 2 and into the channel 4. The channel 4 and shank 6 are provided with cooperating screw threads 7 by means of which the segment and fastener are fastened together. Prior to locating of the segment and fastener, first and second spacers 8 and 9 (for example, in the form of washers) are positioned respectively between the casing 2 and segment and the head 5 and casing 2. In the embodiment shown, the spacers 8, 9 encircle the channel 4 and shank 6 respectively.

A radially inner facing wall of the segment circumferentially extending wall 3 is provided with an abradable coating 10 against which, in use, the tips of a rotor blade of a turbine (not shown) enclosed in the casing 2 may rub or cut.

Extending radially outwardly from the segment circumferentially extending wall 3 are side walls 11. Ribs 2*a*, 2*b* extend axially along a radially inwardly facing surface of casing 2. An additional structural component extends between the casing 2 and a radially outer surface of the segment circumferentially extending wall 3 and is retained by the side walls 11 and ribs 2*a*, 2*b*. This arrangement permits axial location of the segment and sealing of the segment/casing gap. The ribs are configured to allow radial movement of the segment. The structural component 12 comprises a double skinned wall having radially inner and outer skins 12*a* and 12*b* respectively. The skins 12*a*, 12*b* are held apart by channel 12*c* which, when assembled, sits around the channel 4. A step 13 extends around the outer surface of the channel 4 near to but spaced from the segment circumferentially extending wall 3 and serves to retain the structural component 12 along a radially extending axis of the assembly. The radially outer skin 12*b* of the structural component 12 is further retained and spaced from the radially inner face of the casing 2 by the first spacer 8.

Seals 14 (for example rope seals) seal the structural component 12 to the radially inner surface of the casing 2. The seals 14 may be adjustable. One or more cooling holes 16 extend through the co-axially aligned channels 4 and 12*c* to assist cooling of the probe.

The assembly 1 may be thermally isolated from adjacent stator components in the turbine. A "W" cross sectioned seal (not shown) may be arranged between these axially adjacent components of the gas turbine engine to allow for sealing during relative contraction and expansion between the segment and adjacent stator components. Strip seals 17 may be provided along axially extending edges of the segment circumferentially extending wall 3 to prevent leakage of combustion gases between adjacent segment assemblies.

Figure 3:
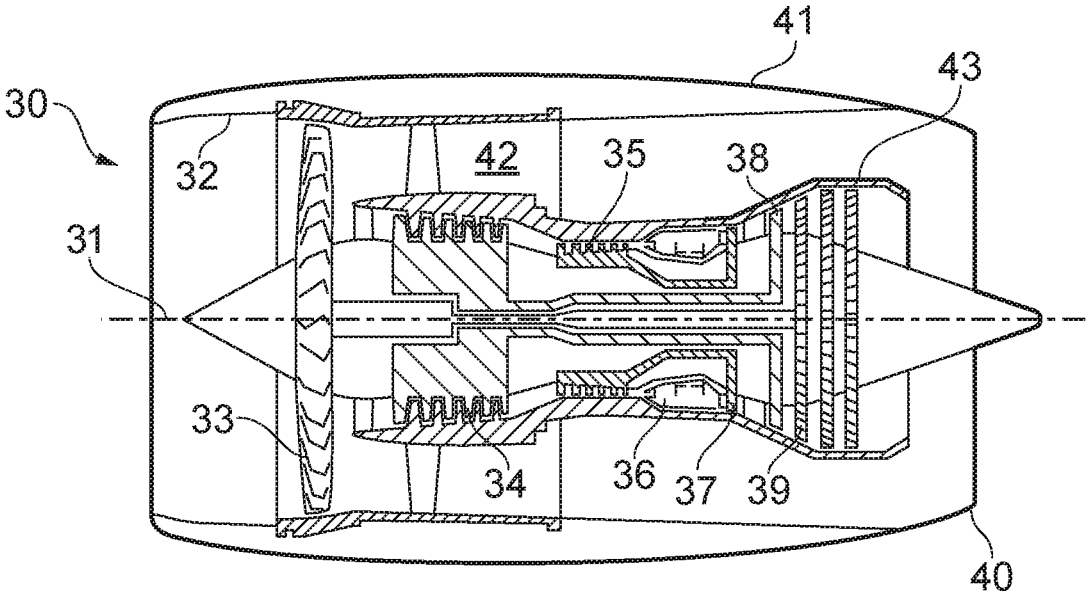
FIG. 3 is a sectional side view of a gas turbine engine incorporating a turbine section and a casing to which assemblies in accordance with the present invention can be affixed.

With reference to FIG. 3, a gas turbine engine is generally indicated at 30, having a principal and rotational axis 31. The engine 30 comprises, in axial flow series, an air intake 32, a propulsive fan 33, an intermediate pressure compressor 34, a high-pressure compressor 35, combustion equipment 36, a high-pressure turbine 37, an intermediate pressure turbine 38, a low-pressure turbine 39 and an exhaust nozzle 40. A nacelle 41 generally surrounds the engine 30 and defines both the intake 32 and the exhaust nozzle 40. A casing 43 surrounds the turbines 37, 38, 39. The shroud assembly of the present invention can be affixed to such a casing.

The gas turbine engine 30 works in the conventional manner so that air entering the intake 32 is accelerated by the fan 33 to produce two air flows: a first air flow into the intermediate pressure compressor 34 and a second air flow which passes through a bypass duct 42 to provide propulsive thrust. The intermediate pressure compressor 14 compresses the air flow directed into it before delivering that air to the high pressure compressor 15 where further compression takes place.

The compressed air exhausted from the high-pressure compressor 35 is directed into the combustion equipment 36 where it is mixed with fuel and the mixture combusted. The resultant hot combustion products then expand through, and thereby drive the high, intermediate and low-pressure turbines 37, 38, 39 before being exhausted through the nozzle 40 to provide additional propulsive thrust. The high 37, intermediate 38 and low 39 pressure turbines drive respectively the high pressure compressor 15, intermediate pressure compressor 34 and fan 33, each by suitable interconnecting shaft.

Other gas turbine engines to which the present disclosure may be applied may have alternative configurations. By way of example such engines may have an alternative number of interconnecting shafts (e.g. two) and/or an alternative number of compressors and/or turbines. Further the engine may comprise a gearbox provided in the drive train from a turbine to a compressor and/or fan.

It will be understood that the invention is not limited to the embodiments above-described and various modifications and improvements can be made without departing from the concepts described herein. Except where mutually exclusive, any of the features may be employed separately or in combination with any other features and the disclosure extends to and includes all combinations and sub-combinations of one or more features described herein.

The invention claimed is:

1. A circumferential shroud assembly for mounting to a casing, the assembly comprising: a plurality of arcuate shroud segments collectively forming the circumferential shroud, each segment comprising a circumferentially extending wall and a channel extending radially outwardly from the wall, the channel configured to be receivable in a hole passing through the casing and having, at an end distal to the wall, a first connector; a fastener having a head and a shank, the shank configured to be received in the channel and having a second connector configured to engage with the first connector of the channel; a first spacer configured to receive the channel and a second spacer configured to receive the shank and sit adjacent the head of the fastener, the spacers to be arranged, in use, either side of the casing, and a retainer for holding the first spacer against a radially inwardly facing surface of the casing, the assembly further comprising a double skinned wall extending around the channel, radially outwardly of the circumferentially extending wall, and the double skinned wall defining a circumferentially extending cooling channel between a radially outer surface of the circumferentially extending segment wall and a radially inner wall of the casing.

2. A circumferential shroud assembly as claimed in claim 1 wherein the connectors comprise complementing screw threads.

3. A circumferential shroud assembly as claimed in claim 2 wherein either or both of the spacers comprises a washer.

4. A circumferential shroud assembly as claimed in claim 1 further comprising additional spacers of different sizes and/or geometries which are configured to be interchangeable with the first and second spacers.

5. A circumferential shroud assembly as claimed in claim 1 wherein the spacer has a curved profile which matches the radii of the casing and/or segment.

6. A circumferential shroud assembly as claimed in claim 1 wherein the fastener is a bolt.

7. A circumferential shroud assembly as claimed in claim 1 wherein the fastener incorporates a probe which is configured and arranged to monitor speed and air tip gap of a rotor encased in the casing.

8. A circumferential shroud assembly as claimed in claim 1 wherein the skins of the double skinned wall are separated by a second channel extending around the shroud segment channel.

9. A circumferential shroud assembly as claimed in claim 8 wherein the second channel incorporates one or more cooling holes.

10. A circumferential shroud assembly as claimed in claim 9 wherein the shroud segment channel is provided with one or more cooling holes co-axially aligned with cooling holes in the second channel.

11. A circumferential shroud assembly as claimed in claim 1 further comprising a step provided on an outer wall of the shroud segment channel to separate the double skinned wall from the circumferentially extending wall of the segment.

12. A circumferential shroud assembly as claimed in claim 1 wherein the double skinned wall incorporates a platform for supporting the first spacer and/or retaining its position with respect to the casing.

13. A circumferential shroud assembly as claimed in claim 1 further comprising one or more seals provided between the double skinned wall and the casing.

* * * * *